United States Patent [19]

Berger

[11] 4,440,318

[45] Apr. 3, 1984

[54] BEVERAGE DISPENSER

[76] Inventor: Irving Berger, 2170 NE. First Ave., Boca Raton, Fla. 33432

[21] Appl. No.: 129,205

[22] Filed: Mar. 11, 1980

[51] Int. Cl.[3] ..... B67D 5/62

[52] U.S. Cl. ..... 222/129.1; 222/144.5; 222/146 C; 222/397; 62/390; 137/635

[58] Field of Search ..... 222/129.1, 144.5, 397, 222/399, 146 C; 137/635, 212; 62/339, 390

[56] References Cited

U.S. PATENT DOCUMENTS

| | | | |
|---|---|---|---|
| 1,600,170 | 9/1926 | Henderson | 222/129.1 |
| 2,014,824 | 9/1935 | Wallace | 62/306 X |
| 2,018,543 | 10/1935 | Buirk | 137/212 |
| 2,086,000 | 7/1937 | Roren | 222/397 X |
| 2,823,833 | 2/1958 | Bauerlein | 222/144.5 X |
| 2,914,218 | 11/1959 | Koroni | 62/339 X |
| 3,024,621 | 3/1962 | Parker | 62/339 |
| 3,108,718 | 10/1963 | Seener | 222/129.1 |
| 3,239,102 | 3/1966 | Heydon et al. | 222/400.7 X |
| 3,280,591 | 10/1966 | Webster | 62/457 X |
| 3,292,822 | 12/1966 | Crowder et al. | 222/129.1 |
| 3,299,663 | 1/1967 | Butcher | 62/339 |
| 3,572,550 | 3/1971 | Colomina et al. | 222/129.1 X |
| 3,710,981 | 1/1973 | Arzberger et al. | 222/129.1 |

*Primary Examiner*—Joseph J. Rolla
*Assistant Examiner*—Frederick R. Handren
*Attorney, Agent, or Firm*—Salter & Michaelson

[57] ABSTRACT

A portable beverage dispenser is disclosed and includes a self-contained unit that is conveniently located on the shelf of the user's refrigerator for dispensing a cooled carbonated drink. The dispenser automatically mixes carbonated water and a syrup of selected flavor and then dispenses the mixture for obtaining a low-cost carbonated drink. The dispenser is of relatively simple construction and includes a water container that receives water from the sink tap and further includes a bottle of carbon-dioxide gas that communicates with the water container for periodically supplying carbonated gas thereto for obtaining the carbonated water. A unique flavor selector valve assembly is embodied in the dispenser and operates to dispense the carbonated drink from a nozzle communicating therewith.

14 Claims, 9 Drawing Figures

BEVERAGE DISPENSER

BACKGROUND OF THE INVENTION

The present invention relates to a portable self-contained beverage dispenser that provides for the immediate dispensing of a cooled soft drink and has particular application for use in the home refrigerator.

Soft or carbonated drinks are normally purchased for home use in either glass bottles or cans which are normally obtained by the consumer in quantities depending upon the frequency of use. Some glass bottles are of the so called "throw-away" variety, and these are preferred by consumers since they do not require storing for return when fresh bottles are purchased. However, throw-away bottles are objectionable because of the inherent disposal problems and thus for ecological reasons are not desirable. Soft drinks that are purchased in metal cans are equally objectionable since the cans must be disposed of or recycled, and disposing of the cans can provide a disposal problem which is also ecologically disadvantageous. Recycling of cans also requires additional time, effort and expense, and although the consumer is not directly involved in the disposal or recycling of bottles and cans there nevertheless is a community interest; but aside from the ecological considerations; the consumer is vitally concerned with the economic disadvantages of purchasing soft drinks from commercial establishments.

Those soft drink beverages that are purchased in returnable bottles, obviously are of some nuisance to the user, since the bottles must be stored for return to the supermarket or other commercial establishment, and not only do bottles provide a storage problem before and after consumption of the soft drink, but present an additional problem in the physical handling thereof in their return to the retail store.

Regardless of the manner in which soft drink beverages are purchased, they still are usually refrigerated to provide a palatable drink, and it is not uncommon for many families to keep several soft drink bottles in the home refrigerator at all times.

Some efforts have been made heretofore to avoid the purchase of bottles or cans of carbonated beverages, and these prior known systems have generally included a beverage dispenser that utilizes some form of a refrigerated carbonated water container and separately located syrup containers. In the prior known constructions, the carbonated water and syrup were mixed to provide a carbonated drink that was supposed to simulate a soft drink as dispensed at a soda fountain. However, these prior known home soda dispensers in most cases did not sufficiently mix the soda water and syrup and the resultant carbonated drink was not always palatable and satisfactory for the consumer's use. Further, these prior known home dispensers were somewhat complex in construction and as a result were uneconomical in the use thereof. In most instances, the prior known home beverage dispensers included a small refrigerator as part of the unit, which also materially increased the cost of the use of the unit.

The present invention is intended to provide a convenient carbonated drink dispenser that is portable and that is easily stored in the home refrigerator, and that further is economical in the use thereof so that a considerable savings is effected by use of the subject invention over that experienced in the use of bottles and cans as presently experienced by the consumer.

Of the prior known dispensing devices of which applicant is aware and that pertain to the subject invention, reference is made to the following U.S. Pat. Nos. Wallace, 2,014,824; Schwab, 2,032,722; Clarke et al, 2,085,956; Rubinfield, 2,515,570; Mueller, 3,069,869; Seener, 3,108,718; Baker, 3,191,402; Webster, 3,280,591; Bean, 3,266,672; and Cserny, 3,354,668.

SUMMARY OF THE INVENTION

The present invention relates to a portable beverage dispenser that has primary use in the home refrigerator and includes a housing in which a water container is located. The water container is provided with a water inlet for receiving water from the kitchen sink and also includes a carbonated water outlet. A pressurized gas vessel is also located in the housing adjacent to the water container and normally contains carbon dioxide gas therein. A gas line extends from the gas vessel and communicates with the interior of the water container, the carbon dioxide gas being periodically directed to the water container through the gas line, wherein the gas cooperates with the water in the container upon refrigeration thereof to produce carbonated water therein. A dispensing assembly is mounted in the housing at the front thereof and includes a plurality of dispensing valves, one of which communicates with the water container for receiving the carbonated water therefrom. At least one syrup container is mounted in the housing and communicates with another of the dispensing valves for directing syrup thereto, the dispensing assembly further including a mixing chamber with which the dispensing valves communicate. An actuating mechanism is formed as part of the dispensing assembly and is operated by the user to actuate the valves for simultaneously introducing the carbonated water and syrup into the mixing and dispensing chamber for mixing therein, whereafter the carbonated mixture is dispensed from a nozzle into a drinking container.

Accordingly, it is an object of the present invention to provide a portable beverage dispenser that automatically makes carbonated water and that mixes the carbonated water with a selected syrup for dispensing a carbonated drink.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
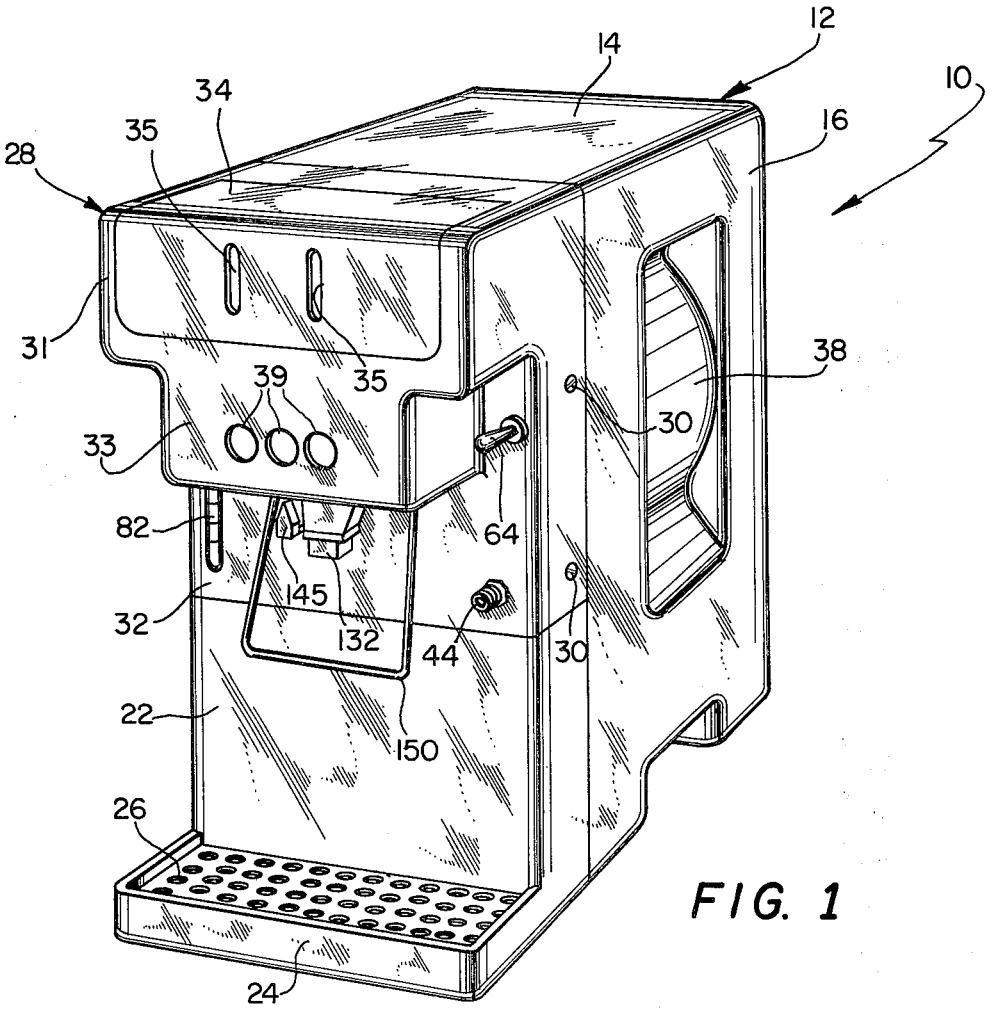
FIG. 1 is a perspective view of the portable beverage dispenser embodied in the present invention.

Referring now to the drawing and in particular to FIG. 1, the portable beverage dispenser embodied in the present invention is illustrated and is generally indicated at 10. The beverage dispenser 10, as will be described hereinafter, is intended for use in a refrigerated area, and in this connection is constructed and includes a housing having physical dimensions that enable it to be located on a shelf of a domestic refrigerator. Thus, the refrigerated area as defined by the interior of the domestic refrigerator provides for carbonating of water as contained in a water vessel that is located in the dispenser housing.

Figure 3:
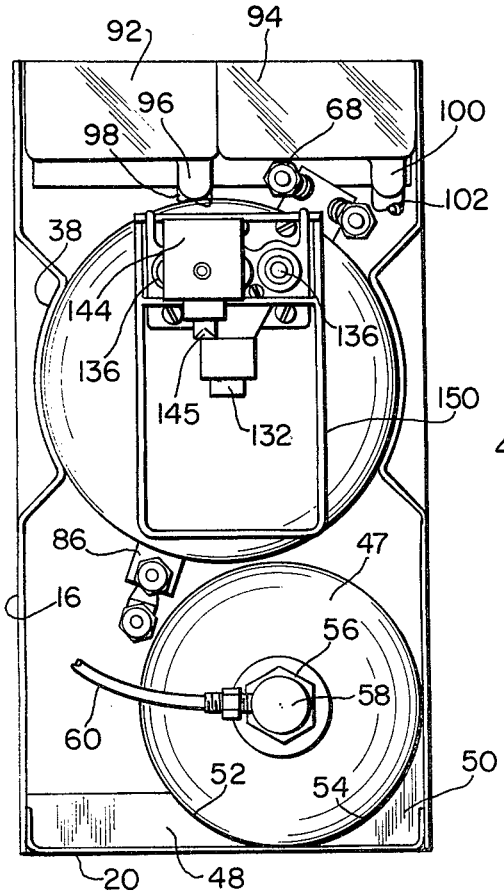
FIG. 3 is a front elevational view of the interior of the beverage dispenser housing with the cover thereof removed.

As illustrated in FIG. 1, the portable beverage dispenser 10 includes a main housing portion generally indicated at 12 that is formed with a top wall 14, side walls 16 and a bottom wall 20 (FIG. 3). As will be described, the housing walls are molded of a suitable plastic material, the side walls 16 and bottom wall 20 thereof being shaped to define interior cavities that accomodate a water container and a gas vessel in snug fitting relation. The housing 12 also includes a lower front cover 22 that projects outwardly at the bottom-most end thereof to define recessed platform 24 on which a perforated tray 26 is located. It is understood that in use of the dispenser 10, a drinking cup would be placed on the tray 26 of the platform 24 in a dispensing position. An upper cover member generally indicated at 28 is also formed as part of the main housing portion 12 and is secured to the side walls 16 thereof by appropriate screws 30. The upper cover member 28 is molded in a preshaped configuration to define a forwardly projecting upper portion 31, a lower portion 32 and a reduced downwardly projecting upper portion 33 that accomodates the dispensing assembly of the dispenser as will hereinafter be described. A removeable cover plate 34 formed in a right angle configuration is received in an appropriate opening in the upper portion 31 and provides for mannual access to a pair of syrup containers as will further hereinafter be described. Slots 36 are formed in the cover plate 34 and provide visual access to the syrup containers for enabling the user to determine the syrup level in each of the containers. Spaced indicator windows 39 are also formed in the downwardly projecting portion 33 of the upper cover member and define visual means for locating a selector member in the proper position upon selection of a desired syrup flavor, as will be described.

Figure 2:
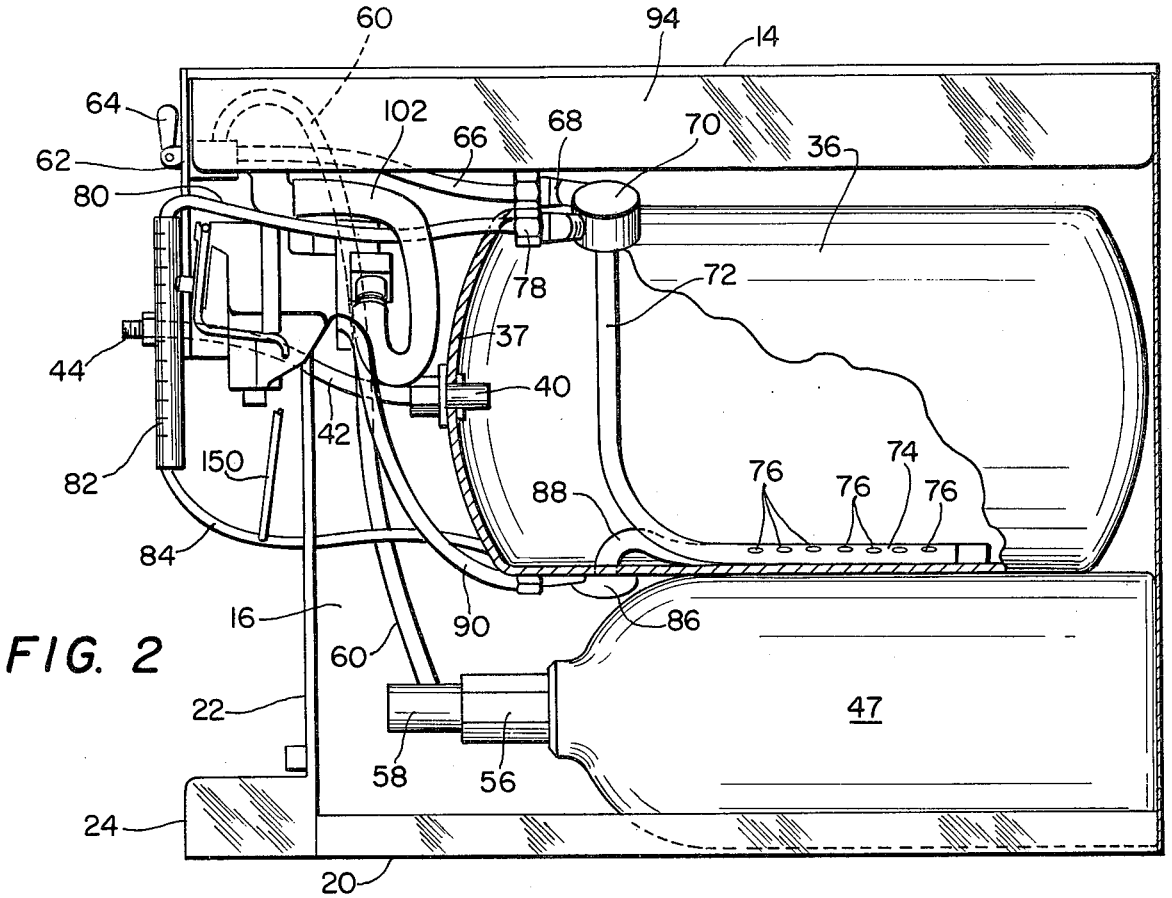
FIG. 2 is a side elevational view of the interior of the beverage dispenser with a side of the housing removed, portions of the water container being broken away and shown in section.

Since the beverage dispenser 10 is a self-contained unit, a water container 36 is mounted within the housing 12 and receives water from a source such as tap water, the tap water being eventually carbonated to provide the carbonated water used in the dispensing of the carbonated soft drink from the dispenser. As illustrated in FIGS. 1 and 3, the side walls 16 of the main housing 12 are formed with interior concave portions 38 that are arcuate in configuration and conform to the cylindrical configuration of the water container 36. The interior arcuate portions 38 thus receive the water container 36 therebetween and support the water container in the suspended position within the housing as illustrated in FIGS. 2 and 3. Projecting inwardly of a front wall 37 of the container 36 is an inlet tube 40 that communicates with a flexible tube 42 exteriorly of the container 36, the flexible tube 42 being connected to a connector 44 that extends through the downwardly projecting portion 32 of the upper cover member 28. As will be described, a quick connect coupling 45 (FIG. 4) attached to an elongated flexible hose 46 (FIG. 4) is securable to the connector 44, the opposite end of the elongated flexible hose 46 being connectable to the tap of a kitchen sink. Thus, upon attachment of the elongated flexible hose 46 to the connector 44, tap water can then be introduced into the interior of the water container 36 as required.

When the water container 36 is depleted of water following periodic dispensing of carbonated drinks, it is necessary to replenish the water supply and, as described, water from a sink tap is directed to the water container through the connector 44 and inlet 40. After the container 36 has been refilled, it is then necessary to carbonate the water therein for purposes of supplying the carbonated water in the dispensing operation. As illustrated in FIGS. 2 and 3 a replaceable gas bottle 47 is also mounted within the housing 12, and as shown is defined by a metal bottle of typical cylindrical configuration in which carbon dioxide gas has been introduced under pressure. In order to accomodate the gas bottle 47 within the housing 12, the bottom wall 20 thereof is formed with raised portions 48 and 50 (FIG. 3) as an integral part thereof, interior curved surfaces 52 and 54 being formed on the raised portions 48 and 50 respectively. The curvature of the surfaces 52 and 54 conform to the shape of the cylindrical gas bottle 47 and receive the bottle 47 thereon in nested relationship. As shown more clearly in FIG. 3, the gas bottle 47 is located beneath the water container 36, the configuration of the housing 12 providing for the location of the water container and gas bottle in snug fitting relation therein.

As shown more clearly in FIG. 2, a neck 56 is joined to the bottle 47 and receives a valve 58 thereon, the valve 58 controlling release of the carbon dioxide gas within the gas container 46 for introduction into the water container 36. A flexible conduit 60 is interconnected to the neck 56 and communicates with a pressure relief valve 62, that is mounted interiorly of the downwardly projecting portion 32 of the front cover 28. The pressure relief valve 62 includes a vent 63 (FIG. 4) and an actuating toggle member 64 which projects outwardly of the downwardly projecting portion 32 of the front cover 28.

As will be described, the pressure relief valve 62 provides for venting of gas from the water container 36 prior to the introduction of the carbon dioxide gas therein during a gas charging operation. Connected to the vent valve 62 is a conduit 66 that also communicates with the interior of the water container 36 through a coupling 68 that is joined to a T-connector 70. Coupled to the T-connector 70 is an interior tube 72 that extends inwardly of the water container 36 terminating at the lower end thereof in a gas outlet portion 74 formed with a plurality of holes 76 therein.

The T-connector 70 also has a coupling 78 joined thereto to which a conduit 80 is connected, the conduit 80 extending through a front sight level glass 82 that is also located exteriorly of the downwardly extending portion 32 of the upper cover portion 28 and is visible exteriorly of the housing 12. The conduit 80 emerges from the gauge 82 at the lower end thereof as conduit 84 that communicates with the interior of the water container 36 through a T-connector 86. Also coupled to the T-connector 86 is an interior conduit 88 that is located at the bottommost end of the water container 36 adjacent to the gas outlet portion 74. It is seen that the gauge 82 which is located in communication with the conduit 80 and 84 extends exteriorly from the upper to the lower end of the water container 36 and thus indicates the level of water therein. Also joined to the T-connector 86 is an outlet line 90 that communicates with a dispensing assembly as will hereinafter be described. In this connection, carbonated water is directed under pressure outwardly of the water container 36 through the conduit 88, T-connector 86 and outlet line 90 to the dispensing assembly during a dispensing operation.

In the dispensing of the carbonated drink by the subject invention, the carbonated water directed to the dispensing assembly is mixed with a syrup of selected flavor. It is contemplated that two flavors of syrup will be stored in the dispenser, so that the user has a choice of selecting the flavor of the syrup that is directed to the dispensing assembly for producing the desired carbonated drink, and for this purpose syrup containers 92 and 94 are provided. As shown in FIGS. 2 and 3, the syrup containers 92 and 94 are located at the uppermost end of the housing 12, and are disposed just beneath the top wall 14 in overlying relation with respect to the water container 36. Each of the containers 92 and 94 contain a syrup of selected flavor therein that is gravity fed to a mixing and dispensing area, the syrup container 92 including a neck portion 96 that is joined to the bottommost end thereof and to which a syrup feed line 98 is connected. Similarly, a neck portion 100 is joined to the underside of the syrup container 94 and has a syrup feed line 102 connected thereto. As will be described, the syrup feed lines 98 and 102 extend into the dispensing assembly and direct the syrup from the containers 92 and 94 by gravity feed thereto.

Figure 7:
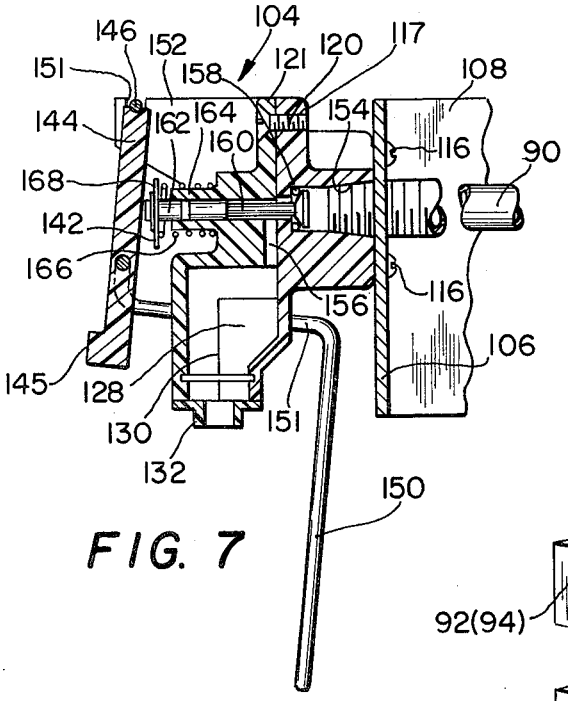
FIG. 7 is a sectional view taken along lines 7—7 in FIG. 5.
Figure 8:
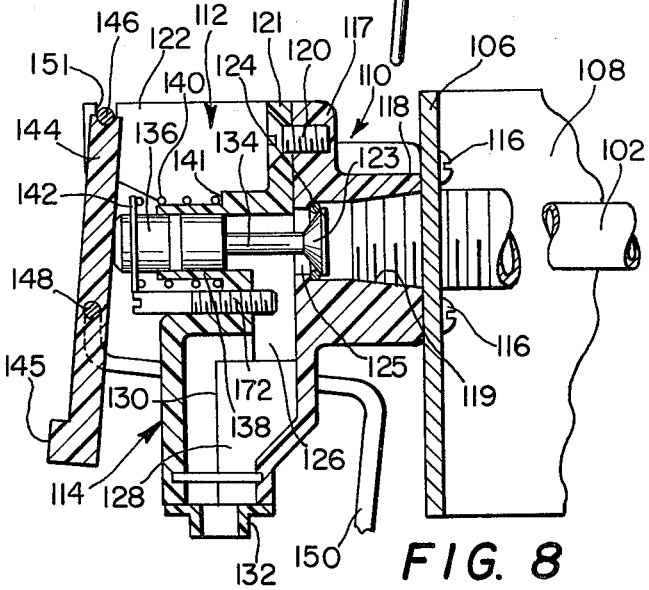
FIG. 8 is a sectional view taken along line 8—8 in FIG. 5.

Referring now to FIGS. 5–8 the dispensing assembly is illustrated and is generally indicated at 104. The dispensing assembly 104 is mounted on a U-shaped bracket 106 that includes side members 108 that are secured interiorly of the sides 16 of the housing 12. Formed as part of the dispensing assembly 104 is a valve body defined by a rear body portion generally indicated at 110, a forward body portion 112, and a mixing and dispensing member generally indicated at 114 that is joined to the valve body at the lowermost end thereof. The rear body portion 110 of the valve body is secured to the bracket 106 through bolts 116 and includes a wall 117 to which rearwardly extending projections 118 are formed, spaced bores, one of which is indicated at 119 being formed in the projections 118. The bores 119 communicate with the syrup feed lines 98 and 102 that are joined to the neck portions 96 and 100 of the syrup containers 92 and 94 respectively, syrup being directed to each of the passages 119 from the syrup containers by gravity. The rear body portion 110 of the valve body is secured to the forward body portion 112 by bolts 120 that extend through a wall 121 and into the wall 117 as shown in FIG. 8. Side walls 122 are joined to the wall 121 and support an operating member as will be described. In order to control the flow of syrup through the passages 119 from the syrup containers to the mixing and dispensing member 114, a valve 123 is provided for each passage and in the closed position each valve 123 engages an O-ring 124 located in an opening 125 that communicates with a passage 119. The opening 125 communicates with a passageway 126 formed in the forward valve body portion 112 and that extends downwardly into the mixing and dispensing member 114, the passageway 126 directing the selected syrup into a mixing chamber 128 of the mixing and dispensing member 114. A partition 130 is located in the mixing chamber 128 and provides for the deflection and effective mixing of the syrup as it enters the mixing chamber with the carbonated water that is also directed thereto as will hereinafter be described. An outlet nozzle 132 is formed on the lowermost end of the mixing and dispensing member 114 for directing the mixed carbonated liquid to a drinking container.

The flow of the syrup through the opening 125 is controlled by axial movement of the valve 123 which includes a valve stem 134 to the outermost end of which a plunger 136 is secured. The plunger 136 is slidably received in a bore as formed in a tubular portion 138 of the outer body 112, a spring 140 surrounding the tubular portion 138 and located between a shoulder 141 as formed on the tubular portion 138 and a washer 142 that is secured to the plunger 136. Thus, the spring 140 normally urges the plunger 136, valve stem 134 and valve 123 to the closed position thereof. As will be described, a selector member 144 is engageable with either of the plungers 136, selectively controlling the feeding of syrup to the mixing and dispensing member 114 for simultaneously controlling the flow of carbonated water thereto for mixing with the syrup.

As shown in FIGS. 5 through 8, the selector member 144 is slidably and pivotably movable on an upper bar 146 and a lower bar 148, the bars 146 and 148 being joined to parallel vertical bars 149 that are joined to an operating trip member 150 through intermediate connector bars 151. The operating trip member 150 extends below outlet nozzle 132 for engagement by the user when it is desired to dispense a mixed soft drink into a drinking container. As further shown in FIGS. 5 and 8, the upper bar 146 on which the selector member 144 is mounted is rotatably received in appropriate slots as formed in the side walls 122 that are secured to the wall 121 of the forward valve body portion 112.

Figure 5:
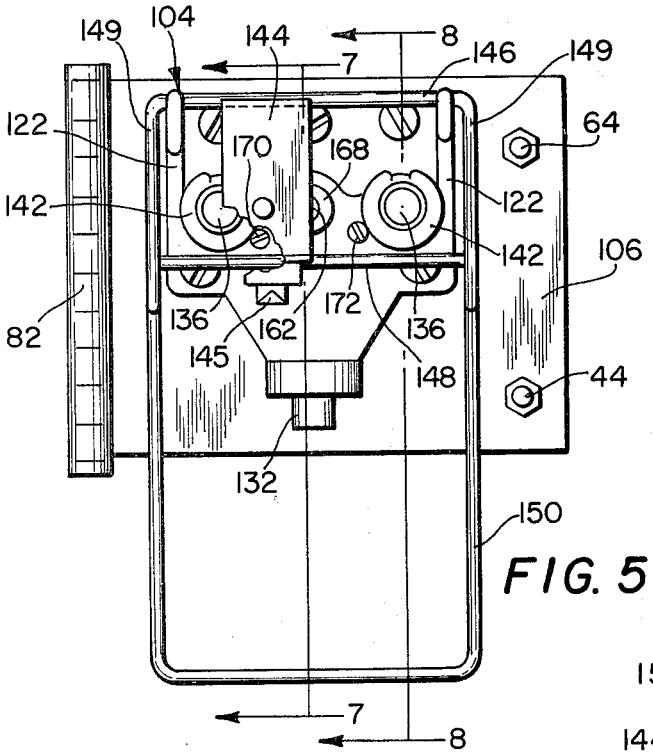
FIG. 5 is a front elevational view of the dispensing assembly with portions broken away.
Figure 6:
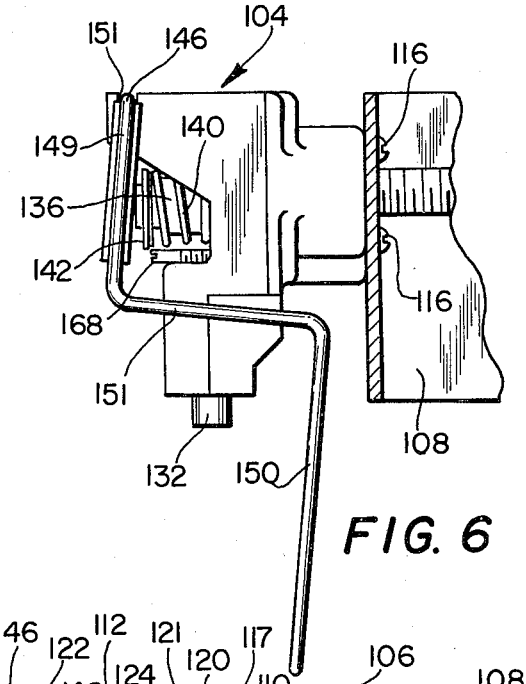
FIG. 6 is a side elevational view of the dispensing assembly.

Referring now to FIG. 7, a central bore 154 is shown formed in the rear valve body portion 110 of the dispensing assembly 104, the bore 154 communicating with the conduit 90 that directs the carbonated water from the water container 36 to the mixing and dispensing station. As shown, the bore 154 for the carbonated water is somewhat smaller in diameter than the bores 119 through which the syrup is directed, the decrease in diameter of the bore 154 providing for increased velocity of flow of the carbonated water to the mixing and dispensing station. As shown in FIG. 5, a soda dispensing mechanism that controls flow of soda through the bore 154 is located intermediate the syrup dispensing passageways 119 through which the syrup is fed, the bore 154 also communicating with the mixing and dispensing chamber 130 by way of a central passageway 156. The soda dispensing mechanism includes a valve 158 that controls communication between the bore 154 and the passageway 156. The valve 158 is joined to a stem 160 to the outermost end of which a plunger 162 is joined. The plunger 162 extends through a bore as formed in a projection 164 of the outer valve body portion 112, and a spring 166 encircles the projection 164 and bears against a shoulder thereof and a washer 168 and normally retains the valve 158 in the closed position thereof. As will be described, the slide selector 144 also engages the soda plunger 162 for moving the valve 158 to the open position thereof in the dispensing operation.

In order to feed the soda or carbonated water to the mixing chamber 128 the bore 154 is located in direct communication with the conduit 90. The conduit 90 communicates with the interior of the water container 36 through the T-connector 86 and the pipe 88 that extends interiorly of the water container at the bottom thereof. Thus, when the slide selector 144 engages the plunger 162 during the dispensing operation, the plunger 162 is moved inwardly thereby moving the valve 158 to the open position thereof. The carbonated water under pressure within the tank 36 then flows through the conduit 90 into the bore 154 and through the passageway 156 for mixing with syrup in the mixing chamber 128. The carbonated water as mixed with the selected syrup is then ejected or dispensed from the nozzle 132 into a convenient drinking container.

As shown more clearly in FIG. 5, the slide selector member 144 is arranged and constructed for movement in a lateral direction on the wire supports 146 and 148 of the operating member 150 so that in any given position, the selector member 144 will overlie the plunger 162 of the carbonated water control valve and one of the syrup control valves. The selector member 144 also includes a pointer 145 that is formed thereon at the bottom and that projects exteriorly of the lowermost edge of the downwardly projecting portion 33. Alignment of the pointer 145 with one of the end window indicators 39 (FIG. 1) will indicate the flavor of syrup to be dispensed. As illustrated in FIG. 5, the selector member 144 has been moved to a position whereby it overlies the soda plunger 162 and the plunger 136 that controls the valve 123 that provides for feed of syrup from the container 92 through the conduit 98. If the user should desire to dispense a carbonated drink with the syrup as contained in the container 94, then the selector member 144 is slidably moved to the opposite end of the wire supports 146 and 148 so that it overlies the plunger that controls the valve that communicates with the conduit 102 and the syrup container 94. In both positions, the selector member 144 also engages the soda plunger 162. With the selector member 144 in the desired position, the operative member 150 is pivotally moved inwardly to pivot the selector member 144 relative to the side walls 122 thereby depressing the soda water plunger 136 and the plunger that controls the valve that provides for feed of the selected syrup into the mixing chamber 128. The mixture of soda water and syrup is then ejected through the nozzle 132 into a drinking container. It is also understood that when the selector member is located centrally of the bars 146 and 148, it overlies only the plunger 162 and only soda water will be dispensed upon pivotal movement of the operating member 150.

In order that the user may control the amount of syrup that is mixed with the carbonated water in accordance with the taste of the user, metering screws 170 and 172 are provided. As shown more clearly in FIG. 8, metering screw 172 is illustrated and extends through the valve body portion 112 of the dispensing assembly 104 and projects into the passageway 126. The outermost end of the metering screw 172 is located in alignment with the slide member 144 for engagement thereby when it is pivoted inwardly during a dispensing operation, and thus the axial location of the metering screw 168 will determine the amount of pivotal movement of the selector member. By limiting the inner pivotal movement of the selector member 144, the movement of the valve 120 is controlled to limit the flow of syrup through the opening 124 and the passageway 126 and into the mixing chamber 128.

Figure 4:
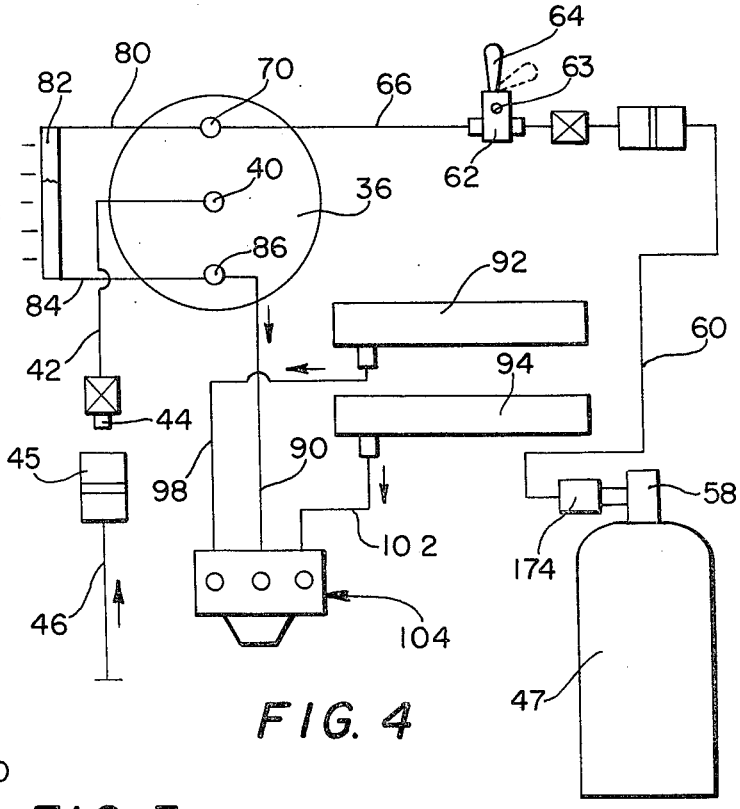
FIG. 4 is a diagrammatic flow diagram illustrating the component parts of the beverage dispenser embodied herein.

Referring now to FIG. 4, an operating sequence of the beverage dispenser will now be described. Prior to introducing the carbonating gas into the water container 36, the valve 58 of the gas bottle 47 is closed. Any residual gases remaining in the water container 36 are evacuated by moving the pressure relief valve toggle 64 to the dotted line position, wherein the valve 62 seals the line 60 from the gas bottle 47 and simultaneously opens the line 66 to the vent 63. After the water container 36 has been evacuated of residual gases, the pressure relief valve 62 is closed by moving the operating toggle 64 to the upright position as shown in FIG. 4, and the quick connect coupling 45 that is secured to the water hose 46 is then snapped onto the connector 44, the other end of the water hose 46 being fixed to the water tap of a sink. The sink water valve is then opened to allow tap water to enter the container 36 through the conduit 42 and the connector 40. After the container 36 has been filled as indicated by the sight indicator 82, the sink valve is closed and the quick connect coupling 45 removed from the connector 44. Thereafter, the water as introduced into the water container 36 is carbonated by opening the valve 58 of the gas bottle 47. The carbon dioxide gas then flows into the water container 36 through the conduit 60, valve 62 and line 66. The gas is directed through the conduit 72 which conducts the gas to the openings 76 for exit at the bottommost end of the container. The spaced openings 76 disperse the gas through the water for effective mixing therein. Since the dispenser unit during this operation, is located in the refrigerator of the user, the refrigerated area in which the unit is located acts to produce the carbonated water after a predetermined period of time. In this connection, carbonation of the water will occur in approximately five to six hours after introduction of the carbon dioxide gas into the water container.

After carbonation of the water in the container 36 has occurred and with the syrup containers 92 and 94 filled with syrups of selected flavors, a carbonated drink can then be dispensed by locating a drinking container on the tray 26 beneath the nozzle 132. With the selector member 144 located in the selected position, the user presses inwardly on the operating member 150 which causes the selector member 144 to pivot inwardly into contact with the carbonated water plunger 162 and the plunger 136 of the selected syrup valve. The mixture of carbonated water and syrup is then directed into the mixing chamber 128, the mixture thereof being promoted by the carbonated water and syrup striking the partition 130. This produces a mixing and atomizing action, and the mixture of carbonated water and syrup is then directed to the dispensing nozzle 132 and outwardly thereof into the drinking container. As previously described, the mixture of the selected syrup and the carbonated water may be controlled by locating the metering screws 170, 172 in the desired positions thereof.

Figure 9:
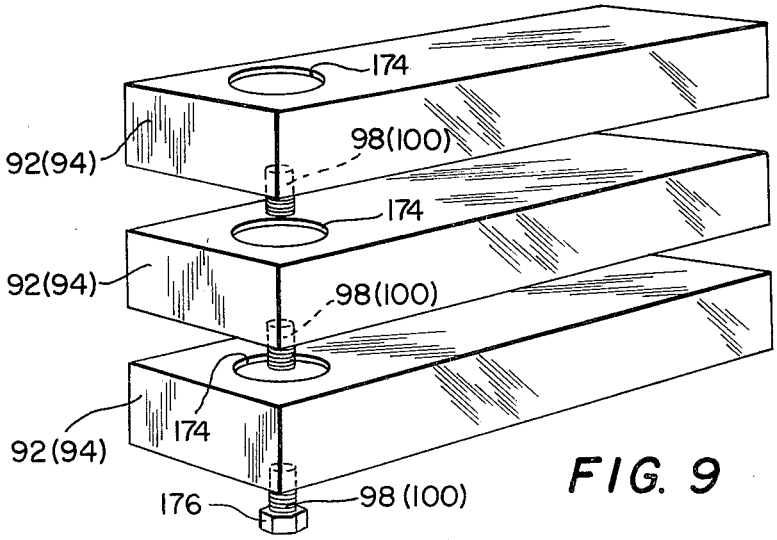
FIG. 9 is a perspective view of several syrup containers that are constructed for nesting in the packaging or storing thereof.

On occasion it may be desirable to store the syrup containers and for this purpose, the neck portions 98 or 100 of the containers 92 or 94 as shown are located directly under the fill opening that is formed in the uppermost surface or wall of each of the syrup containers. In this connection the fill opening is preferably formed with an inwardly directed cup portion 174 that defines the fill opening. Thus, as shown in FIG. 9 when the syrup containers are stored or shipped, the neck portions are received within the cup portions 174 of the lowermost syrup container so that the syrup containers can be nested. The neck portions may also be capped by an end cap 176 to seal the containers during shipping or storing.

It is seen that the beverage dispenser embodied in the present invention dispenses carbonated drinks from a single nozzle that is activated by a single operating lever and this lever may be tripped or pivoted by the user with a drinking cup located on the tray 26 or by urging the cup against the lever. Thus, the dispensing operation may be accomplished by using only one hand. The selector member 144 is movable to the desired position by a simple sliding movement thereof and thus only one lever controls the dispensing valves for obtaining the selected carbonated drink. If only carbonated water is desired, the selector member is centered with the pointer 145 aligned with the center indicator 39, wherein only the soda plunger 162 is dispensed upon tripping of the operating lever 150. The water tank 36 is easily refilled by means of a separate hose that is connected to the tap of the sink and the water may be easily and simply carbonated by merely opening the valve 58 of the carbon dioxide bottle 47. It is also understood that after the bottle 47 has been exhausted of gas it is removed from the housing 12 by removing the front cover member 28, uncoupling the line 60 from a coupling 174 (FIG. 4) and then sliding the bottle outwardly from its nested position. A charged bottle is thereafter installed in the housing and coupled to the line 60.

It is seen that the use of the subject invention avoids the purchase of bottles and cans which either must be disposed of or returned to the market place from which they were purchased. Thus, the subject invention effectively reduces the overall cost of each carbonated drink consumed by the users. Further, a fresh carbonated drink is always available and the flavor of the drink may be enhanced simply by rotating the metering screws 168 as desired.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A portable beverage dispenser for use in a refrigerator comprising a housing, a water container located in said housing and having a water inlet joined thereto for receiving water from a source for introduction into said water container, a water connector mounted in said housing at the front thereof for exterior access thereto, said water connector being interconnected to said water inlet that is joined to said water container, and a flexible hose disconnectably secured to said water connector and to a tap water outlet for directing tap water to the interior of said water container, and a carbonated water outlet communicating with the interior of said water container, a gas vessel located in said housing adjacent to said water container and having a carbon gas under pressure therein, a gas conduit extending from said gas vessel and communicating with the interior of said water container, means connected to said gas vessel for periodically supplying said carbon gas to said water container through said gas conduit, wherein said gas cooperates with said water upon refrigeration thereof to produce carbonated water in said water container, a dispensing assembly mounted on said housing and including a plurality of dispensing valves, one of which communicates with said water container for receiving carbonated water therefrom, at least one syrup container mounted in said housing and communicating with another of said dispensing valves for directing syrup thereto, said dispensing assembly further including a mixing chamber with which said valves communicate, and means joined to said dispensing assembly for actuating said valves for simultaneously introducing the carbonated water and syrup into said mixing chamber for mixing therein, whereafter the carbonated mixture is dispensed into a drinking container, a second syrup container mounted in said housing, said dispensing assembly including at least one other dispensing valve that has communication with said second syrup container, and a flavor selector device that is engageable with said dispensing valves and that is movable into engagement with a selected valve to provide for the combined dispensing of a selected syrup and said carbonated water to obtain the carbonated mixture in the drinking container, said selector device being laterally movable to simultaneously engage the valve for dispensing said carbonated water and a selected syrup valve for jointly introducing the carbonated water and selected syrup into said mixing chamber for the dispensing of the carbonated mixture into said drinking container.

2. A portable beverage dispenser as claimed in claim 1, the end of said gas conduit that is located within said water container having a plurality of openings formed therein, said openings providing for dispersal of said carbon gas in said water to aid in effecting the carbonation thereof.

3. A portable beverage dispenser as claimed in claim 2, the perforated end of said gas conduit being located at the lowermost end of said water container.

4. A portable beverage dispenser as claimed in claim 1, means for controlling the opening of said syrup dispensing valve for metering the flow of syrup therethrough, thereby controlling the ratio of syrup to carbonated water during the dispensing operation.

5. A portable beverage dispenser as claimed in claim 1, said water connector including a quick connect adaptor and valve that receives a complementary connector joined to said hose, wherein pressure of the water received from said tap water outlet opens said valve to provide for flow of said water to the interior of said container.

6. A portable beverage dispenser as claimed in claim 1, said means connected to said gas vessel for periodically supplying said carbon gas to said water container through said gas conduit being defined by a valve assembly that includes a relief valve interconnected to said water container and communicating with the interior thereof for venting gas from said water container prior to directing carbonated gas therein from said gas container.

7. A portable beverage dispenser as claimed in claim 1, at least one other syrup container mounted in said housing adjacent to said first syrup container, said syrup containers being located vertically above said dispensing valves, and conduit means interconnecting said syrup containers with said dispensing valves, wherein the syrup in said containers is gravity fed to said dispensing valves for the selective dispensing thereof to said mixing chamber during the dispensing operation.

8. A portable beverage dispenser as claimed in claim 7, each of said syrup containers including an opening in the upper wall thereof for receiving syrup therein for filling the containers and a neck projecting outwardly of the lower wall thereof through which the syrup is gravity fed to the dispensing valves, said containers being nested for storing or shipping by locating the projecting neck of one container in the opening of the container disposed thereunder.

9. A portable beverage dispenser as claimed in claim 1, said housing including a top wall and a bottom wall to which spaced side walls are integrally joined to form a one-piece construction, the interior of said side walls having concave portions formed therein that are located intermediate said top and bottom walls and that cooperate to define a circular cavity that receives said water container in supporting relation therein.

10. A portable beverage dispenser as claimed in claim 9, said bottom wall having a concave interior portion formed thereon that is shaped to receive said gas container therein for positively locating said gas container at the bottom of said housing.

11. A portable beverage dispenser for use in a refrigerator, comprising a housing, a water container located in said housing and having a water inlet joined thereto for receiving water from a source under line pressure, means interconnected to said water inlet while said housing and container are located in said refrigerator for introducing water under line pressure into said water container without removing the water container from said housing, and a carbonated water outlet communicating with the interior of said water container, a gas vessel located in said housing adjacent to said water container and having a carbon gas under pressure therein, a gas conduit extending from said gas vessel and communicating with the interior of said water container, valve means connected to said gas conduit for periodically controlling the supply of said carbon gas to said water container through said gas conduit, wherein said gas cooperates with said water upon refrigeration thereof to produce carbonated water in said water container, said valve means further being operable to bleed said water container of excess gas prior to water being introduced therein, a dispensing assembly mounted on said housing and including a plurality of dispensing valves, one of which communicates with said water container for receiving carbonated water therefrom, at least one syrup container mounted in said housing and communicating with another of said dispensing valves for directing syrup thereto, said dispensing assembly further including a mixing chamber with which said valves communicate, and means joined to said dispensing assembly for actuating said valves for simultaneously introducing the carbonated water and syrup into said mixing chamber for mixing therein, whereafter the carbonated mixture is dispensed into a drinking container, a second syrup container mounted in said housing, said dispensing assembly including at least one other dispensing valve that has communication with said second syrup container, and a flavor selector device that is engageable with said dispensing valves and that is movable into engagement with a selected valve to provide for the combined dispensing of a selected syrup and said carbonated water to obtain the carbonated mixture in the drinking container, said selector device being laterally movable to simultaneously engage the valve for dispensing said carbonated water and a selected syrup valve for jointly introducing the carbonated water and selected syrup into said mixing chamber for the dispensing of the carbonated mixture into said drinking container, each of said valves including a valve stem to the innermost end of which a valve member is joined, the valve members controlling communication between the dispensing assembly and the syrup containers and water container, each of said valve stems being engageable by said laterally movable selector device and being axially movable thereby to move said valve members to the open position thereof, thereby providing for flow of said carbonated water and selected syrup to said mixing chamber.

12. A portable beverage dispenser as claimed in claim 11, means for controlling the opening of said syrup dispensing valves for metering the flow of syrup therethrough, thereby controlling the ratio of syrup to carbonated water as directed to said mixing chamber during the dispensing operation.

13. A portable beverage dispenser as claimed in claim 12, said controlling means including an adjustable stop member for each valve that is located adjacent thereto and that is axially adjustable relative thereto, one of said stop members being engageable by said selector device during the dispensing operation to limit inward movement of the stem of the selected valve, thereby controlling the flow of the selected syrup to the mixing nozzle.

14. A portable beverage dispenser for use in a refrigerator, comprising a housing, a water container located in said housing and having a water inlet joined thereto for receiving water from a source for introduction into said water container, a water connection mounted in said housing at the front thereof for exterior access thereto, said water connector being interconnected to said water inlet that is joined to said water container, and a flexible hose disconnectably secured to said water connector and to a tap water outlet for directing tap water to the interior of said water container, and a carbonated water outlet communicating with the interior of said water container, a gas vessel located in said housing adjacent to said water container and having a carbon gas under pressure therein, a gas conduit extending from said gas vessel and communicating with the interior of said water container, means connected to said gas vessel for periodically supplying said carbon gas to said water container through said gas conduit, wherein said gas cooperates with said water upon refrigeration thereof to produce carbonated water in said water container, a dispensing assembly mounted on said housing and including a plurality of dispensing valves, one of which communicates with said water container for receiving carbonated water therefrom; a plurality of syrup containers mounted in said housing, each of said syrup containers communicating with one of said dispensing valves for directing syrup thereto, said dispensing assembly further including a mixing chamber with which said valves communicate, and means joined to said dispensing assembly for actuating said valves for simultaneously introducing the carbonated water and syrup into said mixing chamber for mixing therein, whereafter the carbonated mixture is dispensed into a drinking container, and a unitary selector device that is simultaneously engageable with the valve through which the carbonated water is directed and with a selected syrup dispensing valve to provide for the combined dispensing of a selected syrup and carbonated water, said selector device being manually movable into simultaneous engagement with a selected syrup dispensing valve and said carbonated water dispensing valve for obtaining the desired flavored beverage for dispensing into said drinking container.

* * * * *